US010327561B2

(12) United States Patent
Sherman et al.

(10) Patent No.: US 10,327,561 B2
(45) Date of Patent: Jun. 25, 2019

(54) SPLIT SECTION MATTRESS

(71) Applicants: Philip R Sherman, Melville, NY (US); Philip W McCarty, Natick, MA (US)

(72) Inventors: Philip R Sherman, Melville, NY (US); Philip W McCarty, Natick, MA (US)

(73) Assignee: PPJ, LLC, Natick, MA (US)

( * ) Notice: Subject to any disclaimer, the term of this patent is extended or adjusted under 35 U.S.C. 154(b) by 364 days.

(21) Appl. No.: 15/194,996

(22) Filed: Jun. 28, 2016

(65) Prior Publication Data

US 2017/0202360 A1 Jul. 20, 2017

Related U.S. Application Data

(60) Provisional application No. 62/280,876, filed on Jan. 20, 2016.

(51) Int. Cl.

| | |
|---|---|
| ***A47C 27/14*** | (2006.01) |
| ***A47C 20/08*** | (2006.01) |
| ***A47C 20/04*** | (2006.01) |

(52) U.S. Cl.

CPC ..... *A47C 20/08* (2013.01); *A47C 20/04* (2013.01); *A47C 27/144* (2013.01); *A47C 27/146* (2013.01)

(58) Field of Classification Search

CPC ..... A47C 27/14
USPC ..... 5/730–731, 722, 657
See application file for complete search history.

(56) References Cited

U.S. PATENT DOCUMENTS

| | | | | |
|---|---|---|---|---|
| 4,893,365 | A | 1/1990 | Justice | |
| 5,111,542 | A * | 5/1992 | Farley | A47C 27/148 5/727 |
| 7,389,554 | B1 | 6/2008 | Rose | |
| 8,973,183 | B1 * | 3/2015 | Palashewski | A47G 9/0246 5/482 |
| 2015/0182397 | A1 | 7/2015 | Palashewski et al. | |
| 2015/0182399 | A1 | 7/2015 | Rose et al. | |
| 2015/0290059 | A1 | 10/2015 | Brosnan et al. | |

FOREIGN PATENT DOCUMENTS

EP 1 867 255 A1 12/2007

* cited by examiner

*Primary Examiner* — Fredrick C Conley
(74) *Attorney, Agent, or Firm* — Patent Porfolio Builders PLLC

(57) ABSTRACT

A split section mattress has a pair of opposing ends defining a mattress length there between and a pair of opposing sides extending between the opposing ends and defining a mattress width there between. At least one end split passes completely through a thickness of the split section mattress and extends partially along the mattress length from one of the pair of opposing ends to define two separate split sections in the split section mattress. A plurality of cuts extends into the split section mattress from the top face. The plurality of cuts is formed as a plurality of straight lines extending across the split section mattress.

20 Claims, 7 Drawing Sheets

SPLIT SECTION MATTRESS

CROSS-REFERENCE TO RELATED APPLICATIONS

The present application claims priority to and is a non-provisional of U.S. Provisional Patent Application No. 62/280,876 filed Jan. 20, 2016, which is incorporated herein in its entirety by reference.

TECHNICAL FIELD

Embodiments of the subject matter disclosed herein relate to mattresses and in particular to mattresses for use with adjustable, articulating bed foundations and frames.

BACKGROUND

Adjustable or articulating beds provide selectable adjustment of the lower or foot portion and upper or head portion of a mattress from a traditional flat or horizontal position. Therefore, the head or foot of a user can be elevated as desired, for example, for comfort, to provide relief from snoring or to facilitate reading. The upper and lower portions are adjustable independent of each other. Adjustment is provided by an articulating foundation mounted on a frame and supporting the mattress.

While a twin-sized adjustable bed is arranged for a single user, larger beds such as full-sized, queen-sized and king-sized adjustable beds are arranged to fit two users, one on either side of the bed. The adjustable bed foundations for these larger bed sizes can be configured to provide separate upper and lower portion adjustment for each side of the bed. Separate and independent adjustment for each side of the mattress, however, would not work with a conventional single mattress. Separate mattresses would be needed. For example, two separate twin mattresses could be used for king-sized bed frames. However, the use of two separate mattresses may not be comfortable, and separate mattresses are not an option for queen-sized and full-sized adjustable beds.

A solution that has been proposed is the use of a single mattress that provides for separate movement of the head and foot sections of either side of the mattress using a split down the middle of the mattress from either end that leaves a central portion that extends the entire width of the mattress. However, this split represents a binding point as the two sides move relative to each other. In addition, previous attempts do not always provide the desired level of flexibility and positioning for each individual section. Therefore, an improved mattress is desired that provides for independent movement of both head and foot sections on either side of a two-person mattress while eliminating binding between adjacent sections and facilitating increased flexibility in each individual section.

SUMMARY

Embodiments are directed to split section mattresses, adjustable bed systems and methods for making and using the mattresses and adjustable bed systems where the mattress includes at least one of a split head or top section and a split foot section. The split section mattress includes a single split section mattress, i.e., a single split extending in from a single end of the mattress, and a dual split mattress, i.e., two splits extending in from opposite ends of the mattress. The upper or head section, i.e., a split top section, and the lower or foot section, i.e., a split foot section, of the mattress provide for independent articulation of each head and foot section on either side of the mattress and independent adjustable movement of either side of the mattress. The mattress has an "H" or butterfly appearance when view from the top or bottom of the mattress and can be used with full-sized, queen-sized and king-sized adjustable bed frames. The mattress allows independent adjustability when using a bed frame with two adjustable base foundations, e.g., two twin XL foundations, two split queen foundations and two split California king foundations. The central portion of the mattress remains a single piece spanning an entire width of the mattress. Suitable mattresses include, but are not limited to, foam mattresses, spring mattresses and air component mattress systems.

The split section mattress allows independent flexibility of head and foot positions on either side of the mattress in combination with a single sleep surface for two users. The two split top sections and the two split foot sections on either side of the mattress can articulate independently between an flat, horizontal or down position and an inclined or up position. Therefore, the articulating bed foundations with separately articulating head and foot sections do not have to be synchronized and work together on a single full-sized, queen-sized, king-sized mattress or California king-sized mattress. The split section mattress provides the benefit of individual, independent customized positioning on either side of the mattress.

In one embodiment, the mattress includes at least two splits, cuts or slots passing completely through the thickness of the split section mattress. Each split extends into the split section mattress, i.e., extending along the length, from the center, i.e., center point of the width, of one end of the split section mattress. In one embodiment, each split extends along the split section mattress a length of from about 26 inches to about 28 inches. Therefore, each split defines two halves at one of the head end and the foot end of the split section mattress. Preferably, each split extends along the split section mattress less than one half the overall length of the split section mattress. Therefore, the splits from either end of the split section mattress do not meet or overlap. This defines a center section of the split section mattress that is not split and that extends the entire width of the split section mattress. Each split, cut or slot has a width of defines a gap between adjacent sides of the split or sections of the split section mattress of up to about 0.5 inches. This spacing or gap eliminates wear and friction between the two sides of the split. In addition, the terminal end of each split in the interior of the split section mattress has a rounded or "U" shape that is reinforced on the split section mattress structure at both hinge points, i.e., the split top section and the split foot section. Friction between the two sections is further reduced by extending the upholstery on the outward facing side panels of the split section mattress completely through the interior, facing surfaces of each split.

To improve flexibility in the split section mattress and in each separately adjustable section of the split section mattress, the split section mattress includes a plurality of surface-modification technology (SMT) cuts extending along the width of the split section mattress. The cuts appear as lines or grooves extending at least partially across the width of the split section mattress. In one embodiment, the cuts are located in the top of the split section mattress and in particular in the base foam layer of the split section mattress. Each cut in the plurality of cuts is located in one of a plurality of locations. The cuts can be single cuts or groupings of multiple cuts.

In one embodiment, the cuts are located in four separate locations, with three separate cuts, i.e., a grouping of three cuts, contained in each of the four separate locations. Two of the four locations are in the center section, i.e., all cuts on these two locations are disposed within the center section of the mattress. Each center section location is adjacent to the end of one of the splits. Therefore, the first cut in the group of three cuts is located adjacent to the end or terminus of one of the splits, with the subsequent cuts in the group of three cuts spaced from the first cut toward the middle of the split section mattress. A third location is in the split top section about halfway down the split or at a location of a user's shoulders. A fourth location is in the split foot section about halfway down the split or at a location of a user's knees. These third and fourth locations provide additional flexibility in the articulating split foot sections and split top sections to provide for additional bending at the neck and knees. Therefore, the cuts or grooves provide increased flexibility of the split section mattress to accommodate the shoulders, lower back, thighs and knees of the user.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
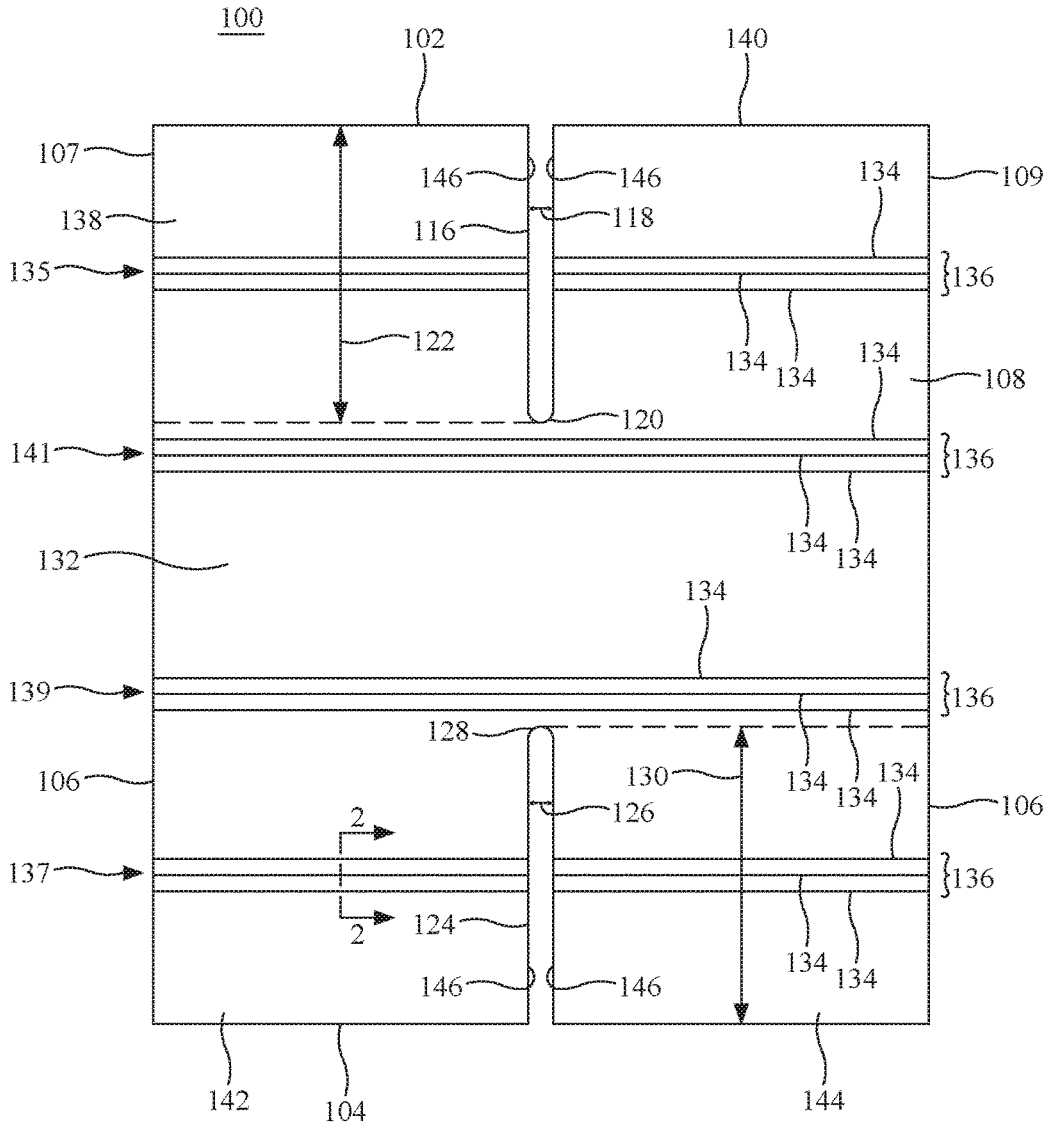
FIG. 1 is a schematic representation of an embodiment of a mattress in accordance with the present invention.
Figure 3:
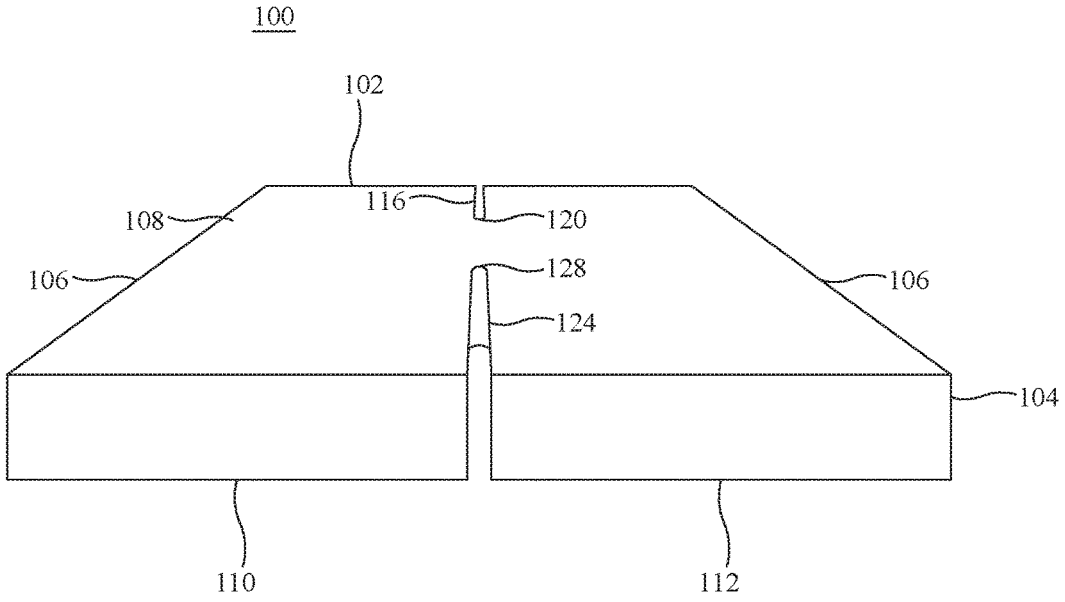
FIG. 3 is a perspective view of the top of an embodiment of the split section mattress with a fabric covering.
Figure 4:
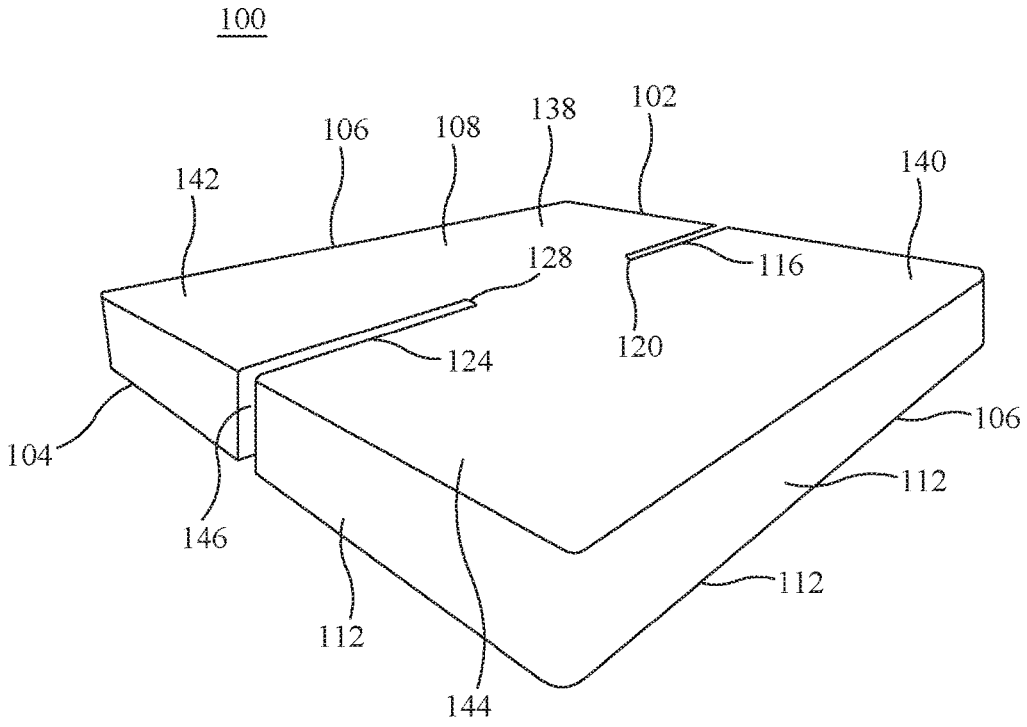
FIG. 4 is another perspective view of the top of an embodiment of the split section mattress with a fabric covering.

Referring initially to FIGS. 1 and 3-4, an embodiment of a split section mattress 100 in accordance with the present invention is illustrated. Suitable mattresses include full-sized mattresses, queen-sized mattresses and king-sized mattress. Suitable types of mattresses include foam mattresses, coil inner spring mattresses and air component mattress systems. The split section mattress includes a pair of opposing ends defining a mattress length there between and a pair of opposing sides defining a mattress width there between. The pair of opposing ends includes a first, top or head end 102 and a second, bottom or foot end 104 opposite the first end. The first and second ends extend along the mattress width of the split section mattress. The pair of opposing sides 106 extends between the pair of opposing ends along the length of the split section mattress. The pair of opposing sides includes a first opposing side 107 and a second opposing side 109. The length and width of the split section mattress include any suitable length and width known and available in the art. In one embodiment, the length and width are associated with full-sized mattresses, queen-sized mattresses or king-sized mattresses.

The split section mattress includes a top face 108, which is the face in contact with the user, and a bottom face 110 opposite the top face. The top and bottom faces can be identical for a two sided mattress than can be flipped. Alternatively, the split section mattress is a one sided mattress. The split section mattress also includes four side or edge faces 112. This includes a first end edge face, a second end edge face and a pair of opposing sides edge faces. The edge faces define the thickness or depth of the split section mattress. All of the faces of the split section mattress can be covered by suitable fabrics or upholstery as is known in the art. In one embodiment, the split section mattress includes a pillow top section 114. Suitable arrangements of pillow top sections are known and available in the art. In general, the pillow top section is mounted on the top face or forms the top face.

Separated and independently adjustable split sections (138, 140, 142, 144) are formed on one or both ends of the split section mattress using at least one end split that passes completely through the thickness of the mattress and that extends along the mattress length from one of the opposing ends. Each end split defines two split sections that each extends between one of the opposing sides and the end split. In one embodiment, the split section mattress includes a first end split 116 extending into the split section mattress from the first end 102. This defines two split top sections, a first split top section 138 on one side of the split section mattress and a second split top section 140 on the other side of the split section mattress. The first split top section is located between the first end split and a first opposing side 107 of the split section mattress, and the second split top section is located between the first end split and a second opposing side 109 of the split section mattress. The first end split 116 passes completely through the depth or thickness of the split section mattress. In addition, the first end split extends into the split section mattress along the length of the split section mattress to a first end split terminus 120 located at a first end split length 122. Suitable lengths are from about 24 inches up to about 30 inches. Preferably, this length is about 27 inches. In one embodiment, the first end split terminus is squared or a point, i.e., the width varies along the length to a point at the first end split terminus where opposite sides of the first end split meet. Preferably, the first end split terminus is rounded or curved.

Figure 6:
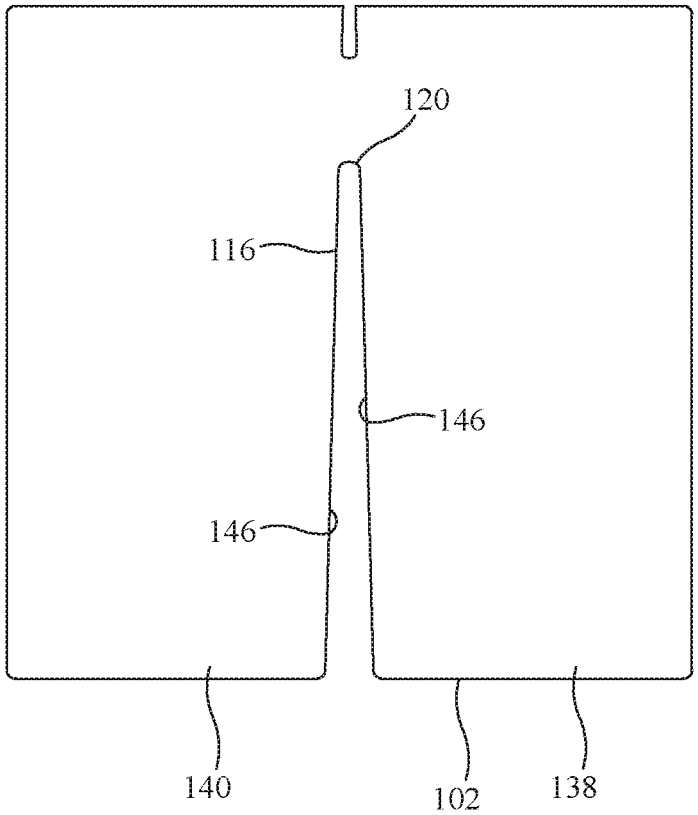
FIG. 6 is a partial perspective view of the top of the split section mattress showing the foot end split with a fabric covering.

The first end split 116 has a first end split width 118 or gap width. In one embodiment, the gap width is constant along the length of the first end split. Referring to FIG. 6, alternatively, the gap width varies along the length of the first end split, for example from a wider width at the end of the mattress to a narrower width or point at the first end split terminus. Returning to FIGS. 1, and 3-4, suitable first end split widths 118 are up to about 1 inch, preferably up to about 0.5 inches. In one embodiment, the first end split width is about 0.5 inches. The first end split width prevents the first end split and the opposing split sections defined by the first end split from binding or rubbing along the first end split. In one embodiment, the opposing internal faces 146 of the first end split that extend the thickness of the split section mattress and that are disposed within the end split include a fabric layer or upholster that completely covers each one of the pair of opposing internal faces. For example, the opposing internal faces can be covered with the same fabrics or upholstery used to cover at least one of the faces or edges of the split section mattress.

The second end split 124 extends in from the second end 104 of the split section mattress. This also defines two split foot sections, a first split foot section 142 on one side of the split section mattress and a second split foot section 144 on the other side of the split section mattress. The first split foot section is located between the second end split 124 and the first opposing side of the split section mattress 107, and the second split foot is located between the second end split 124 and the second opposing side 109 of the split section mattress. The second end split 124 passes completely through the depth or thickness of the split section mattress. In addition, the second end split extends into the split section mattress along the length of the split section mattress to a second end split terminus 128 located a second end split length 130. Suitable lengths are from about 24 inches up to about 30 inches. Preferably, the length is about 27 inches. In one embodiment, the second end split terminus is squared or a point, i.e., the width varies along the length to a point at the second end split terminus where opposite sides of the second end split meet. Preferably, the second end split terminus is rounded or curved.

The second end split 124 has a second end split width 126 or gap width. In one embodiment, the gap width is constant along the length of the second end split. As with the first end split, the gap width can vary along the length of the second end split, for example from a wider width at the end of the mattress to a narrower width or point at the second end split terminus. Suitable second end split widths 126 are up to about 1 inch, preferably up to about 0.5 inches. In one embodiment, the second end split width is about 0.5 inches. The second end split width prevents the second end split and the opposing split sections defined by the second end split from binding or rubbing along the second end split. In one embodiment, the opposing internal faces 146 of the second end split that extend the thickness of the split section mattress and that are disposed within the end split include a fabric layer or upholster that completely covers each one of the pair of opposing internal faces. For example, the opposing internal faces can be covered with the same fabrics or upholstery used to cover at least one of the faces or edges of the split section mattress.

While illustrated with a first end split and a second end split, the split section mattress can include at least one of a first end split and a second end split. In one embodiment, the first and second end splits and the associated dimensions are identical. Alternatively, the first and second end splits and the associated dimensions are not identical. For example, the lengths and widths of the first and second end splits vary. In one embodiment, the dimensions and locations of the first and second end splits are selected to correspond to the dimensions of the articulating foundation. Therefore, the two split top sections and the two split foot sections correspond to the size of the associated moving portions of the articulating foundation.

As the first end split 116 and the second end split 124, either alone or in combination, do not extend completely along the length of the split section mattress, a central portion 132 of the split section mattress is defined. The central portion does not include any splits running along the length of the split section mattress. The central portion is located along the length of the mattress between the first end split terminus and the second end split terminus. In one embodiment, the central portion of the split section mattress is located between the first end split and the second end split and occupies a portion of the mattress length between the first end split and the second end split. The central portion spans the entire mattress width from the first opposing side to the second opposing side. Therefore, the central portion of the split section mattress provides a continuous mattress along the entire width of the split section mattress.

The split section mattress also includes a plurality of surface-modification technology (SMT) cuts 134 or grooves. These cuts extend into the split section mattress from the top face, the bottom face or both the top face and the bottom face. The cuts are a plurality of lines, preferably a plurality of straight lines that extend completely across the width of the split section mattress. Preferably the plurality of lines is a plurality of parallel lines. Any suitable number and location of cuts or grooves can be used to accommodate the desired bending along the length of the split section mattress including the separate adjustment and articulating of the two split top sections and the two split foot sections. Therefore, adjustment is facilitated between the two split top sections and the two split foot sections and the central portion. Preferably, the cuts are straight lines running in parallel; however, other shaped lines can be used and not all cuts have to be parallel to each other. For example, some of the cuts can extend across the width of the split section mattress generally perpendicular to the opposing sides while other cuts extend across the width to intersect the opposing sides at angles other than 90 degrees. In addition, the cuts do not have to extend completely across the width, but can extend partially across the width or a sufficient distance along the width to achieve the desired flexibility and bending in the split section mattress. The cuts can be spaced evenly along the length or width of the split section mattresses or can be arranged in groups or sets of cuts.

Figure 5:
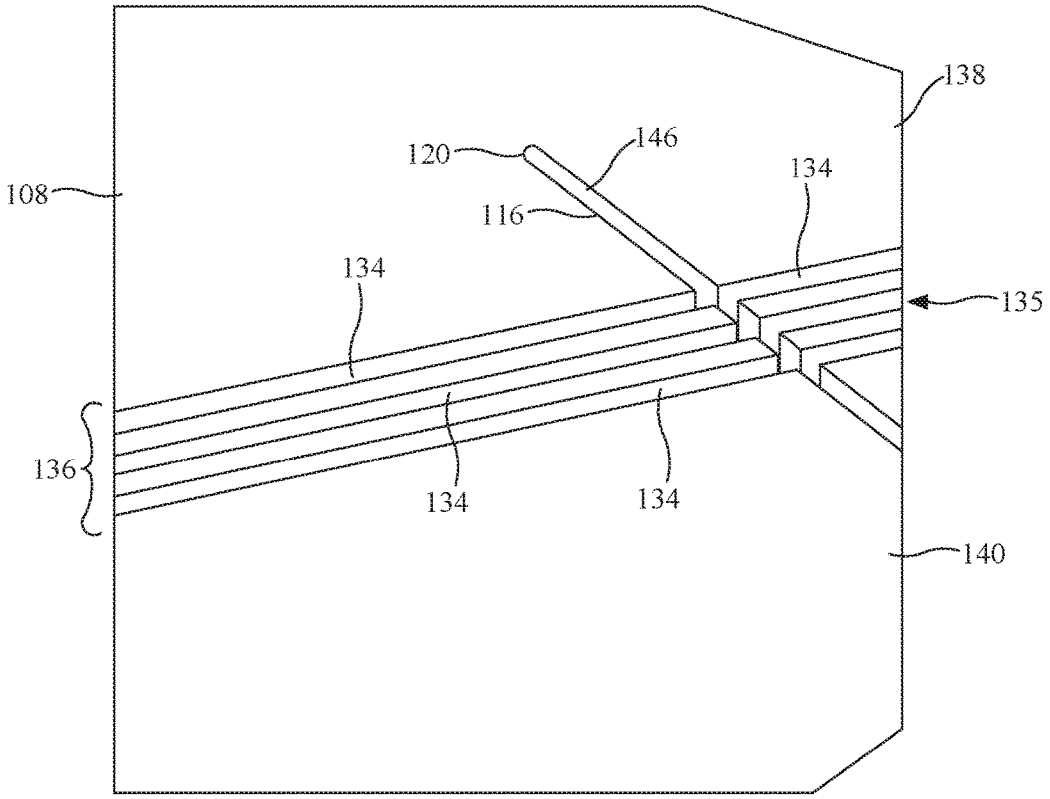
FIG. 5 is a partial perspective view of the top of the split section mattress showing the foot end split and the plurality of cuts.

In one embodiment, the plurality of cuts is arranged as a plurality of sets of cuts. Each set of cuts includes a plurality of cuts. In one embodiment, each set of cuts contains an equal number of cuts. Alternatively, two or more of the sets of cuts contains a unique number of cuts. Preferably, each set of cuts includes at least three cuts. The cuts in a set of cuts are grouped or spaced closer together along the length of the split section mattress than cuts in adjacent sets of cuts. In one embodiment, four groups or sets 136 of cuts are provided, although other numbers of sets of cuts can be used. In one embodiment, the four sets of cuts are located or centered at four different locations along the length of the split section mattress. In one embodiment, at least one of the plurality of sets of cuts is disposed in the split sections such that the plurality of lines within that one of the plurality of sets of cuts intersect the end split (FIG. 5). In one embodiment, at least one of the plurality of sets of cuts is disposed in a portion of the split section mattress other than one of the split sections. For example, at least one of the plurality of sets of cuts is disposed in the central portion. Alternatively, at least two of the plurality of sets of cuts are disposed in the central portion.

As illustrated in FIGS. 1 and 5, a first set of cuts 135 passes through the first and second split top sections 138, 140, intersecting the first end split. In one embodiment, the first set of cuts is located or centered at about the midpoint along the length 122 of the first end split. This location corresponds to the location of the shoulders or neck of the user. A second set of cuts passes 141 through the central portion of the split section mattress past the first and second split top sections and adjacent the first end split terminus 120. This location corresponds to the lower back of the user. A third set of cuts 139 passes through the central portion of the split section mattress past the first and second split foot sections and adjacent the second end split terminus 128. This location corresponds to the location of the upper legs, hips or thighs of the user. A fourth set of cuts 137 is located passes through the first and second split foot sections, interesting the second end split. In one embodiment, the fourth set of cuts is located or centered at about the midpoint along the length 130 of the second end split 124. This location corresponds to the location of the knees of the user. These cuts provide for the bending and folding of each split section at one or two locations along their lengths as illustrated, for example, in FIGS. 7 and 8. The cuts can be provided regardless of whether one or two end splits are provided in the split section mattress. In addition, the cuts can be provided in a mattress without any end splits and can be located as described herein.

Figure 2:
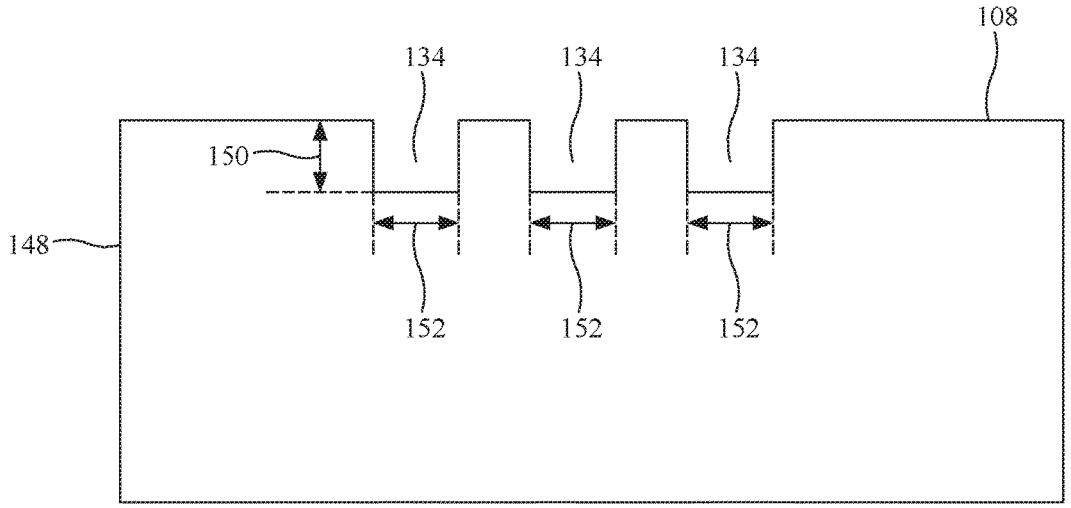
FIG. 2 is a view through line 2-2 of FIG. 1.

Referring to FIG. 2, in one embodiment, each cut 134 extends into the split section mattress, for example, from the top face 108 of the split section mattress. When the split section mattress is constructed of multiple layers, each cut extends into an outer or a top layer 148 of the split section mattress, for example an outer or top layer of foam. For two-sided mattress, cuts extend into the split section mattress for each one of the top face and the bottom face. Each cut or groove extends into the split section mattress a given distance 150. In one embodiment, this given distance is up to about 1 inch, preferably up to about 0.75 inches. In one embodiment, this distance is about 0.75 inches. In addition, each cut has a cut width 152 of up to about 1 inch. Preferably, each cut width is about 1 inch. As illustrated, each cut or groove has a generally rectangular cross-section; however, other cross-sectional shapes are possible including triangular and curved shapes. In one embodiment, each groove is identical. Alternatively, two or more grooves have at least one of different dimensions and different cross-sectional shapes. In general, the size, shape and location of the cuts are selected to facilitate bending of the split section mattress while eliminating or minimizing binding and blousing in the split section mattress.

As illustrated, the cuts extend into the split section mattress or the top layer of the foam from a top face 108 of the split section mattress. Alternatively, or in addition to the top face cuts, the split section mattress can include cuts and sets of cuts extending into the split section mattress from the bottom face. The bottom face cuts can be identical to the top face cuts, i.e., the same arrangement (size shape and location) as the top face cuts or can be different arrangements. In one embodiment, the bottom face cuts are the same as the top face cuts to provide for a two sided mattress. Preferably, the cuts are located underneath any fabric or upholstery covering on the split section mattress and are not visible from the outside of the split section mattress.

Figure 7:
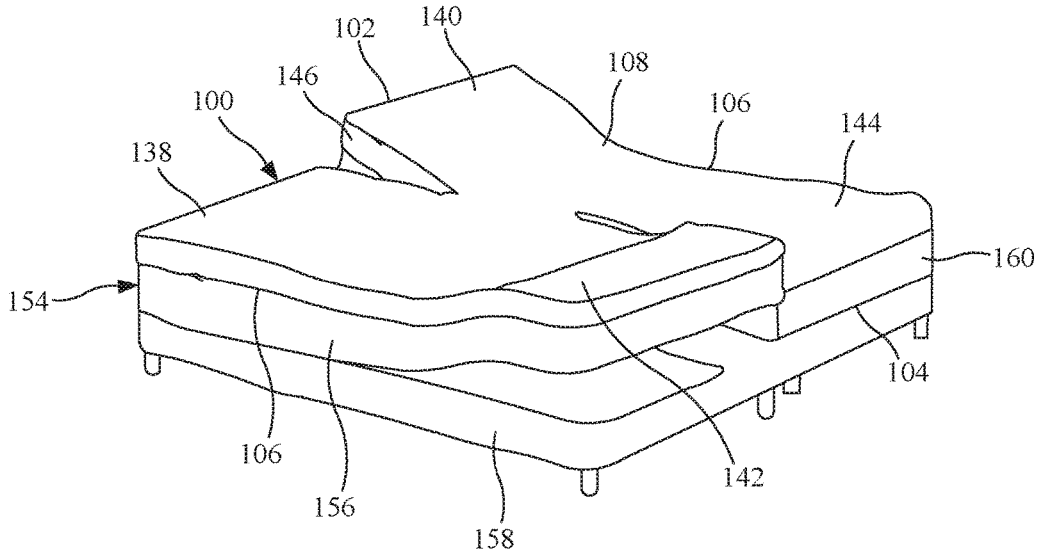
FIG. 7 is a perspective view of the split section mattress mounted on an articulating foundation and frame.
Figure 8:
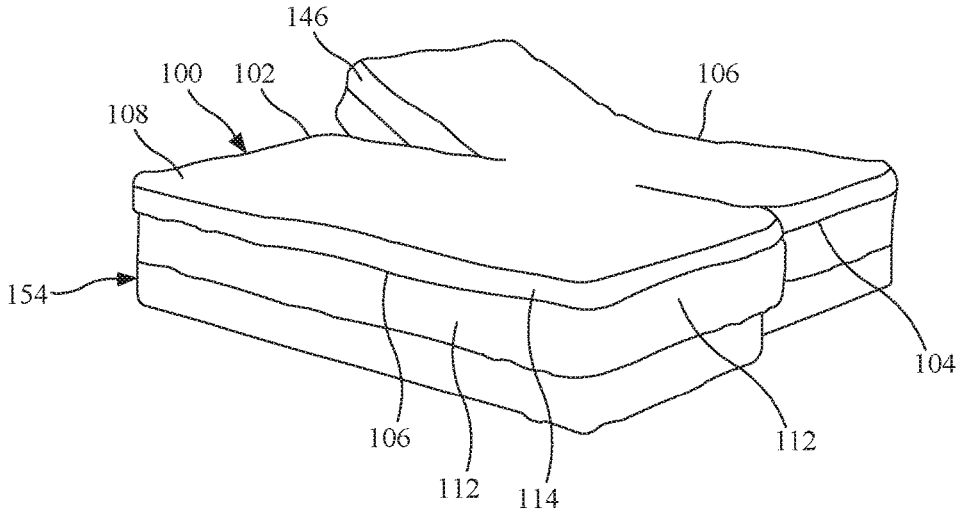
FIG. 8 is a perspective view of the split section mattress mounted on an articulating foundation.

Referring now to FIGS. 7 and 8, in one embodiment, the split section mattress is used in conjunction with an adjustable bed foundation 154 that can be supported on a bed frame 158. The adjustable bed foundation 154 includes a first adjustable or articulating portion 156 of a first side of the bed and a separate second adjustable or articulating portion 160 on a second side of the bed opposite the first side of the bed. Each one of the first and second adjustable or articulating portion provides for separate adjustment of the elevation of the head and foot on either side of the bed. Therefore, these separate articulating portions are aligned with the split section mattress such that the first end split and the second end split pass between the first and second adjustable or articulating portions to provide individual adjustment of the first and second split top sections and the first and second split foot sections. The present invention is also directed to methods of manufacturing and using embodiments of the split section mattress as disclosed herein.

In one embodiment, the present invention is directed to a method of providing separate articulation and adjustment to separate top and bottom sections of a full-sized, queen-sized or king-sized mattress. The method includes forming or providing one or more split sections on one or more ends of a split section mattress. This includes providing a first end split in a mattress that extends in from the first end of the split section mattress to define two split top sections, a first split top section on one side of the split section mattress and a second split top section on the other side of the split section mattress. The first end split is formed to pass completely through the depth or thickness of the split section mattress and to extend into the split section mattress along the length of the split section mattress a first end split length of from about 24 inches up to about 30 inches, preferably about 27 inches. The first end split is formed or provided with a first end split width. In one embodiment, the width is provided to be constant along the length of the first end split. Alternatively, the width is provided to vary along the length of the first end split. In one embodiment, the first end split width is provided up to about 0.5 includes or up to about 1 inch. In one embodiment, the first end split width is formed or provided to be about 0.5 inches. In one embodiment, opposing internal faces of the first end split are covered with fabric or upholstery, for example, by extending the fabrics or upholstery from the faces or sides of the split section mattress into the first end split. Providing or forming the first end split further includes forming a terminus of a desired shaped to terminate the first end split within the split section mattress at the desired length. In one embodiment, forming the terminus includes forming a squared terminus. Alternatively, forming the terminus includes varying the width of the first end split along the length to form the terminus at a point where opposite sides of the first end split meet. Preferably, forming the terminus includes forming a rounded first end split terminus.

In addition to or as an alternative to forming the first end split, the method further includes forming or providing a second end split in the split section mattress that extends in from the second end of the split section mattress to define two split foot sections, a first split foot section on one side of the split section mattress and a second split foot section on the other side of the split section mattress. The second end split is formed or provided to pass completely through the depth or thickness of the split section mattress and to extend into the split section mattress along the length of the split section mattress a second end split length of from about 24 inches up to about 30 inches, preferably about 27 inches.

The second end split is formed or provided with a second end split width. In one embodiment, the width is provided to be constant along the length of the second end split. Alternatively, the width is provided to vary along the length of the second end split. In one embodiment, the second end split width is provided up to about 0.5 includes or up to about 1 inch. In one embodiment, the second end split width is formed or provided to be about 0.5 inches. In one embodiment, opposing internal faces of the second end split are covered with fabric or upholstery, for example, by extending the fabrics or upholstery from the faces or sides of the split section mattress into the second end split. Providing or forming the second end split further includes forming a terminus of a desired shaped to terminate the second end split within the split section mattress at the desired length. In one embodiment, forming the terminus includes forming a squared terminus. Alternatively, forming the terminus includes varying the width of the second end split along the length to form the terminus at a point where opposite sides of the second end split meet. Preferably, forming the terminus includes forming a rounded second end split terminus.

As the first end split and the second end split, either alone or in combination, do not extend completely along the length of the split section mattress and do not overlap along the length of the split section mattress, the method includes defining a central portion of the split section mattress between the split top sections and the split foot sections based on the length of each one of the first end split and the second end split. In one embodiment, defining the central portion does not include providing any splits running along the length of the split section mattress that pass through the central portion. Therefore, the central portion of the split section mattress provides a continuous mattress along the entire width of the split section mattress.

The method further includes making a plurality of surface-modification technology (SMT) cuts in the split section mattress that extend completely across the width of the split section mattress. Any suitable number and location of cuts can be made to accommodate the desired bending in and between the split top sections and the split foot sections. In one embodiment, the cuts are made as straight lines running in parallel; however, other shaped lines can be made, e.g. curved lines. In addition, not all cuts have to be parallel to each other. For example, cuts are made that extend across the width of the split section mattress generally perpendicular to the opposing sides while other cuts are made that extend across the width to intersect the opposing sides at angles other than 90 degrees. In one embodiment, the cuts are made in the split section mattress that do not have to extend completely across the width, but that extend partially across the width or a sufficient distance along the width to achieve the desired flexibility and bending in the split section mattress. Any suitable method known and available in the art for making cuts into the layers or materials of the split section mattress including foam layers can be used.

In one embodiment, four sets of cuts are made in the split section mattress, although other numbers of sets of cuts can be made. Making the four sets of cuts includes locating the sets of cuts at four separate and distinct locations along the length of the split section mattress. In one embodiment, each set of cuts is made with three cuts, although other numbers of cuts can be made in each set. In addition, each set of cuts can made with a different number of cuts. As illustrated, a first set of cuts is made that passes through the first and second split top sections. The first set of cuts is located or centered about halfway along the length of the first end split. This location corresponds to the location of the shoulders or neck of the user. A second set of cuts is made that passes through the central portion of the split section mattress past the first and second split top sections and adjacent the first end split terminus. This location corresponds to the lower back of the user. A third set of cuts is made that passes through the central portion of the split section mattress past the first and second split foot sections and adjacent the second end split terminus. This location corresponds to the location of the upper legs, hips or thighs of the user. A fourth set of cuts is made that is located or centered about halfway along the length of the second end split. This location corresponds to the location of the knees of the user. Therefore, the method including providing for the bending and folding of each split section at two locations along their lengths as illustrated, for example, in FIGS. 7 and 8 by making the plurality of cuts in the split section mattress.

In one embodiment, each cut is made by extending the cut into an outer or a top layer 148 of the split section mattress, for example a layer of foam, a given distance 150. In one embodiment, this given distance is up to about 1 inch, preferably up to about 0.75 inches. In one embodiment, this distance is about 0.75 inches. In addition, making each cut includes making a cut width 152 of up to about 1 inch. Preferably, each cut width is about 1 inch. As illustrated, the cuts are made to extend into the top layer of the foam from a top face of the split section mattress. Alternatively, or in addition to the top face cuts, the method can include making cuts and sets of cuts that extend into the split section mattress from the bottom face. The bottom face cuts can be made with the same arrangement as the top face cuts or can be made using different arrangements. In one embodiment, the bottom face cuts are made the same as the top face cuts to provide for a two sided mattress. Preferably, the method includes covering the split section mattress and the cuts with a fabric layer or upholstery such that the cuts are located underneath any fabric or upholstery covering on the split section mattress and are not visible from the outside of the split section mattress.

The resulting mattress is then placed on an articulating foundation that provides for separate articulation of each side of the bed for at least one of the top section or the foot section of the split section mattress. In one embodiment the split section mattress is fixedly secured to the foundation. In addition, the method includes mounting the foundation on a fixed bed frame. The first and second split top sections and the first and second split foot sections are moved or articulated independently of each other using the adjustable foundation in accordance the positioning preferences of each of two users of the split section mattress.

Although the features and elements of the present exemplary embodiments are described in the embodiments in particular combinations, each feature or element can be used alone without the other features and elements of the embodiments or in various combinations with or without other features and elements disclosed herein. The methods or flowcharts provided in the present application may be implemented in a computer program, software, or firmware tangibly embodied in a computer-readable storage medium for execution by a dedicated computer or a processor.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A split section mattress comprising:

a pair of opposing ends defining a mattress length there between;

a pair of opposing sides extending between the opposing ends and defining a mattress width there between;

an end split passing completely through a thickness of the split section mattress and extending partially along the mattress length from one of the pair of opposing ends to an end split terminus to define two separate split sections in the split section mattress; and a plurality of cuts extending into the split section mattress and comprising a plurality of lines extending across the split section mattress, at least one line located adjacent to the end split terminus.

2. The split section mattress of claim 1, wherein the plurality of lines comprise a plurality of parallel lines.

3. The split section mattress of claim 1, wherein each one of the plurality of lines extend completely across the mattress width.

4. The split section mattress of claim 1, wherein each cut in the plurality of cuts comprises a rectangular cross section having a width less than about 1 inch and a depth of less than about 0.75 inches.

5. The split section mattress of claim 1, wherein the plurality of cuts is arranged as a plurality of sets of cuts, each set of cuts comprising at least three cuts.

6. The split section mattress of claim 5, wherein:

at least one of the plurality of sets of cuts is disposed in the split sections such that the plurality of lines within that one of the plurality of sets of cuts intersect the end split; and at least one of the plurality of sets of cuts is disposed in a portion of the split section mattress other than the split sections.

7. The split section mattress of claim 6, wherein the at least one of the plurality of sets of cuts disposed in the portion of the split section mattress other than the split sections is disposed adjacent the end split terminus.

8. The split section mattress of claim 5, further comprising two end splits passing completely through the thickness of the split section mattress, the two end splits comprising:

a first end split extending in from a first end of the split section mattress to define a first split top section between the first end split and a first opposing side of the split section mattress and a second split top section between the first end split and a second opposing side of the split section mattress; and a second end split extending in from a second end of the split section mattress opposite the first end to define a first split foot section between the second end split and the first opposing side of the split section mattress and a second split foot between the second end split and the second opposing side of the split section mattress;

wherein:

at least one of the plurality of sets of cuts is disposed in the first and second split top sections such that the plurality of lines within that one of the plurality of sets of cuts intersect the first end split; and at least one of the plurality of sets of cuts is disposed in the first and second split foot sections such that the plurality of lines within that one of the plurality of sets of cuts intersect the second end split.

9. The split section mattress of claim 8, further comprising a central portion of the split section mattress between the first end split and the second end split and, the central portion occupying a portion of the mattress length between the first end split and the second end split, and the mattress width from the first opposing side to the second opposing side, wherein at least one of the plurality of sets of cuts is disposed in the central portion.

10. The split section mattress of claim 9, wherein at least two of the plurality of sets of cuts are disposed in the central portion.

11. The split section mattress of claim 1, wherein the end split comprises a gap width between the two separate split sections along the mattress width.

12. The split section mattress of claim 11, wherein the gap width is up to about 0.5 inches.

13. A split section mattress comprising:

a pair of opposing ends defining a mattress length there between;

a pair of opposing sides extending between the opposing ends and defining a mattress width there between; and two end splits passing completely through the thickness of the split section mattress, the two end splits comprising:

a first end split passing completely through a thickness of the split section mattress and extending in from a first end of the split section mattress partially along the mattress length to define a first split top section between the first end split and a first opposing side of the split section mattress and a separate second split top section between the first end split and a second opposing side of the split section mattress; and a second end split passing completely through a thickness of the split section mattress and extending in from a second end of the split section mattress opposite the first end partially along the mattress length to define a first split foot section between the second end split and the first opposing side of the split section mattress and a separate second split foot section between the second end split and the second opposing side of the split section mattress;

wherein each end split comprises a gap width between the separate split sections along the mattress width.

14. The split section mattress of claim 13, wherein the split section mattress further comprises:

a pair of opposing internal faces extending the thickness of the split section mattress and disposed within each end split; and a fabric layer completely covering each one of the pair of opposing internal faces.

15. The split section mattress of claim 13, wherein the gap width is up to about 0.5 inches.

16. The split section mattress of claim 13, wherein each end split comprises a split length and the gap width varies along the split length.

17. The split section mattress of claim 13, further comprising a central portion of the split section mattress between the first end split and the second end split and, the central portion occupying a portion of the mattress length between the first end split and the second end split and spanning the mattress width from the first opposing side to the second opposing side.

18. The split section mattress of claim 13, wherein each end split comprises a split length of from about 24 inches to about 30 inches.

19. A split section mattress comprising:

a pair of opposing ends defining a mattress length there between;

a pair of opposing sides extending between the opposing ends and defining a mattress width there between;

an end split passing completely through a thickness of the split section mattress and extending partially along the mattress length from one of the pair of opposing ends to define two separate split sections in the split section mattress, the end split comprising an end split length; and a plurality of cuts extending into the split section mattress and comprising a plurality of parallel lines extending across the split section mattress, the plurality of parallel lines disposed in the split sections, intersecting the end split and centered on a midpoint of the split length.

20. The split section mattress of claim 19, wherein:

the plurality of cuts is arranged as a plurality of sets of cuts, each set of cuts comprising at least three cuts;

at least one of the plurality of sets of cuts is disposed in the split sections such that the plurality of lines within that one of the plurality of sets of cuts intersect the end split; and at least one of the plurality of sets of cuts is disposed in a portion of the split section mattress other than the split sections.

* * * * *